United States Patent [19]

Ahmed

[11] 3,940,197

[45] Feb. 24, 1976

[54] METHOD OF MAKING A GLOW DISCHARGE READOUT DEVICE

[75] Inventor: Abul Abbas Mesbahuddin Ahmed, Beauford Manor, Pa.

[73] Assignee: AMP Incorporated, Harrisburg, Pa.

[22] Filed: Mar. 26, 1975

[21] Appl. No.: 562,081

Related U.S. Application Data

[60] Division of Ser. No. 468,356, May 9, 1974, Pat. No. 3,891,883, which is a continuation-in-part of Ser. No. 300,631, Oct. 25, 1972, Pat. No. 3,818,556.

[52] U.S. Cl. ..... 316/17; 29/25.14

[51] Int. Cl.[2] ..... H01J 9/00

[58] Field of Search ..... 316/17–20, 316/24; 29/25.11, 25.14, 25.16, 25.15, 25.17, 25.18; 313/217, 494, 519

[56] References Cited

UNITED STATES PATENTS

| | | | |
|---|---|---|---|
| 3,599,027 | 8/1971 | Koshizuka | 313/217 X |
| 3,792,301 | 2/1974 | Kessler | 313/217 X |
| 3,878,420 | 4/1975 | Fein | 313/217 |

*Primary Examiner*—Roy Lake
*Assistant Examiner*—James W. Davie
*Attorney, Agent, or Firm*—Gerald K. Kita

[57] ABSTRACT

In a glow discharge readout, cathodes are arranged on a glass substrate in electrical isolation from a plurality of anodes also on the substrate. Contact pins sealably imbedded in the substrate contact respective anodes and cathodes. A transparent cover forms a sealed envelope encasing the anodes and cathodes within an illuminating gas atmosphere. The anodes are purposely recessed with respect to the cathodes, whereupon an electrical potential impressed between the anodes and selected cathodes will cause electrons to flow from the cathodes to the anodes, the electron stream being focused toward the surface of the glass substrate and away from the transparent envelope thereby preventing electron collision with the transparent envelope. According to the method of the present invention, cathodes are formed from particulate metal particles sintered under pressure and at a temperature below the melting point of the metal particles, but at a temperature sufficient to cause fusion of the substrate material. Upon fusion of the substrate in an inert atmosphere, the anodes, cathodes and contact pins are fused to the substrate simultaneously in a single operation. Applying molding pressure during fusion of the substrate will desirably recess the anodes from the cathodes.

3 Claims, 11 Drawing Figures

METHOD OF MAKING A GLOW DISCHARGE READOUT DEVICE

CROSS-REFERENCE TO RELATED APPLICATION

This is a division of application Ser. No. 468,356, filed May 9, 1974, now U.S. Pat. No. 3,891,883, which is a continuation-in-part application of application Ser. No. 300,631, filed Oct. 25, 1972, now U.S. Pat. No. 3,818,556.

In all prior art glow discharge display devices, sputtering of the cathodes has produced discoloration in the transparent cover of the display device. To prevent this, some prior art devices utilize anode screens against the cover to divert away electrons and sputtered particles. Other prior art devices utilize thin film layers separating anodes and cathodes, requiring electrons to migrate through the film toward the anodes and thus never migrate off the film toward the cover. The present invention provides a method whereby the anodes of a readout device according to the present invention are recessed from the cathodes. Electron emission thus is focused at a recessed anode away from the cover.

In the manufacture of prior art devices, several painstaking operations are required. Contact pins are imbedded in a glass substrate, and ground off flush with the substrate. Metal anodes and cathodes are then welded or brazed to corresponding contact pins establishing electrical connections. The anodes and cathodes are joined adhesively or fusibly to the substrate preventing the anodes or cathodes from lifting off the substrate. In other devices, the anodes and cathodes are silk screened on the corresponding pins. The manufacture of readout devices has heretofore required a relatively large number of operations. Accordingly there has been a need for a manufacturing process which can be performed with a minimum of operations. The present invention also relates to a method of manufacture wherein the anodes, cathodes and contact pins are joined simultaneously to a glass substrate thereby eliminating several operations heretofore required in the prior art.

In a glow discharge readout device, cathodes are arranged on a substrate of glass in electrical isolation from a plurality of anodes also on the substrate. Contact pins sealably imbedded in the substrate contact respective anodes and cathodes. A transparent cover forms a sealed envelope encasing the anodes and cathodes within an illuminating gas atmosphere. The anodes are purposely recessed with respect to the cathodes, whereupon an electrical potential impressed between the anodes and selected cathodes will cause electrons to flow from the cathodes to the anodes, the electron stream being focused toward the surface of the substrate and away from the transparent envelope thereby preventing electron collision with the transparent envelope. According to the method of the present invention, cathodes are formed from particulate metal particles sintered under pressure and at a temperature below the melting point of the metal particles, but at a temperature sufficient to cause fusion of the substrate material. Upon fusion of the substrate in an inert atmosphere, the anodes, cathodes and contact pins are fused to the substrate simultaneously in a single operation. Applying molding pressure during fusion of the substrate will desirably recess the anodes from the cathodes.

It is therefore an object of the present invention to provide a method of fabricating a glow discharge readout device adhering anodes and cathodes and electrical contact pins simultaneously to a fusible glass substrate.

Another object of the present invention is to provide a method for manufacturing a glow discharge readout by simultaneously adhering anodes, cathodes and electrical contact pins to a fusible glass substrate, the cathodes being formed from particulate metal particles sintered under pressure and at a temperature below the melting point of the metal particles, whereby the metal particles are formed to a cohesive mass of individual particles bonded to the fusible substrate while in a molten state.

Another object of the present invention is to provide a method for manufacturing a glow discharge readout wherein anodes, cathodes and electrical contact pins are fused simultaneously to a fusible glass substrate, with the anodes being purposely recessed from the cathodes such that upon operation of the glow discharge readout, electron flow from the cathodes will be focused toward the recessed anodes.

Another object of the present invention is to provide a glow discharge readout having anodes purposely recessed from a plurality of cathodes arranged in a desired pattern on a glass substrate such that during operation of the glow discharge readout, electron flow from said cathodes will be focused toward the anodes and at the surface of the glass substrate and away from a transparent envelope encasing the cathodes and anodes in an illuminating gas atmosphere.

Another object of the present invention is to provide a glow discharge readout apparatus having the cathodes thereof formed from particulate metal particles sintered under pressure and at a temperature below the melting point of the metal particles whereby the particles are formed to a cohesive mass of individual particles becoming bonded to a fusible glass substrate which is reduced to a molten state during sintering of the metal particles.

Other objects and many attendant advantages of the present invention will become apparent upon perusal of the following detailed description taken in conjunction with the accompanying drawings, wherein:

FIG. 3 is an enlarged fragmentary perspective of a portion of the preferred embodiment of FIG. 2 illustrated in section generally along the line 3—3 of FIG. 2;

Figure 1:
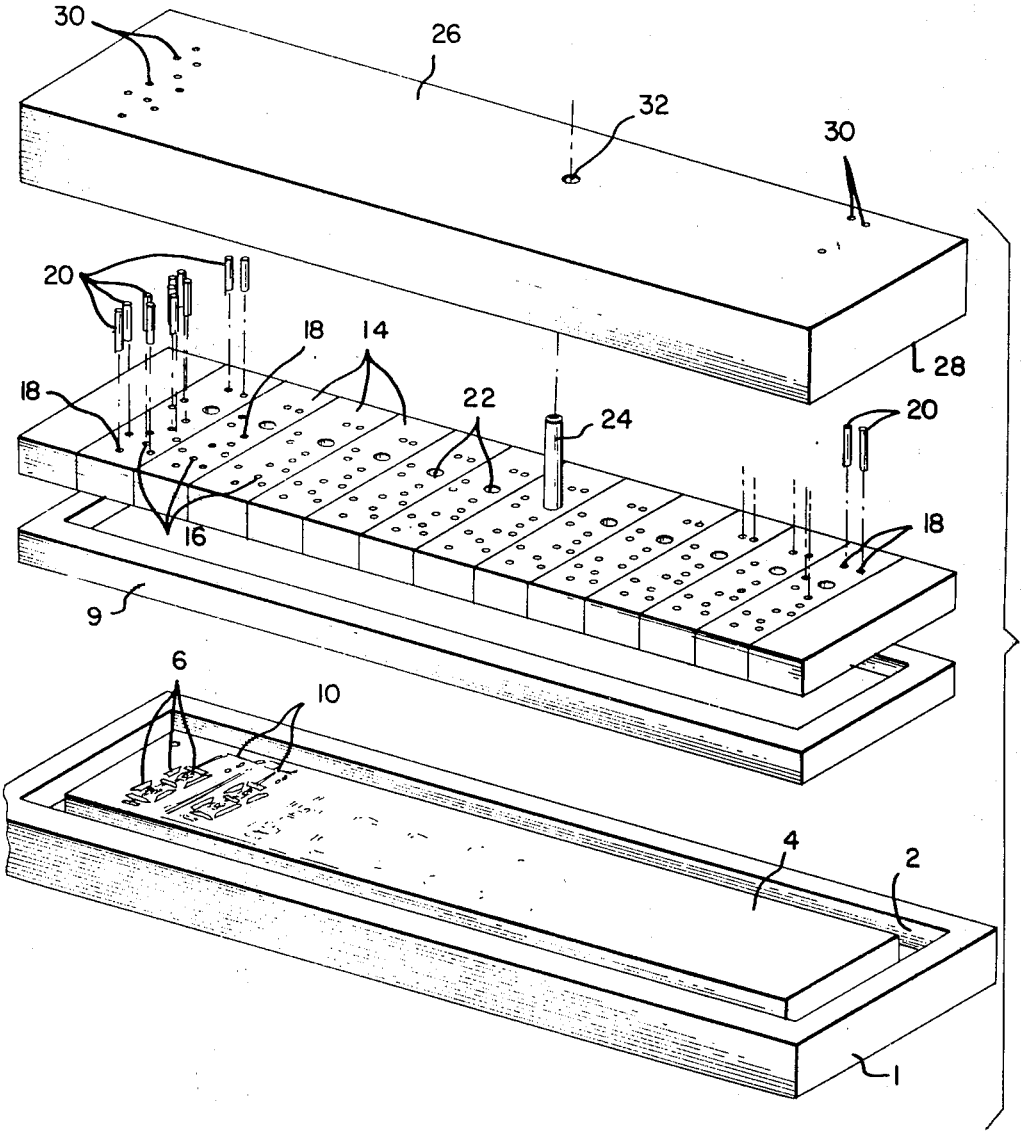
FIG. 1 is a fragmentary perspective of a preferred embodiment with parts in exploded configuration to illustrate the details of apparatus for fabricating a glow discharge readout device according to the present invention, and further illustrating an assembly of selected component parts of the preferred embodiment.
Figure 7:
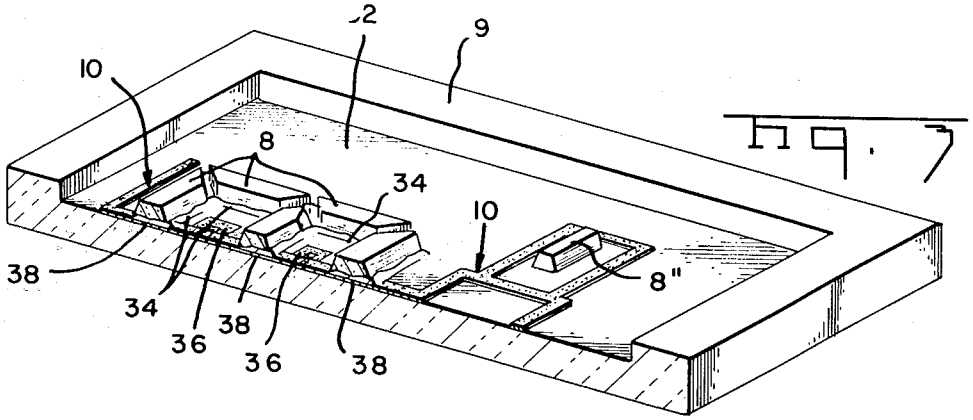
Figure 6:
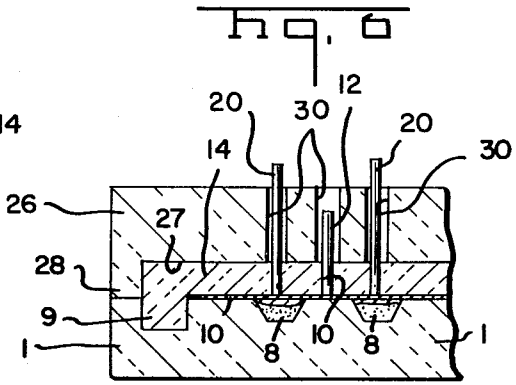
Figure 7:
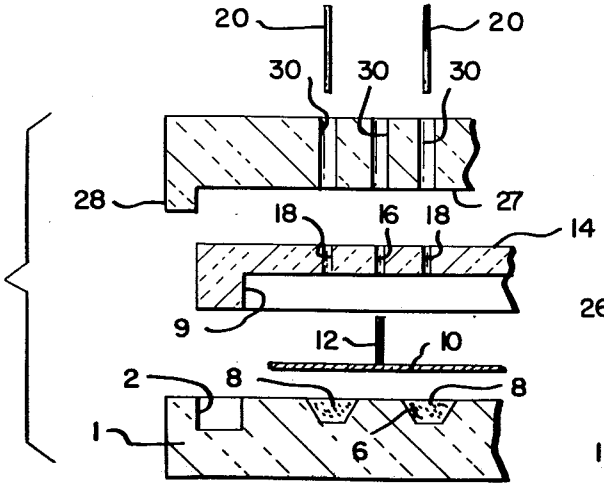
Figure 7:
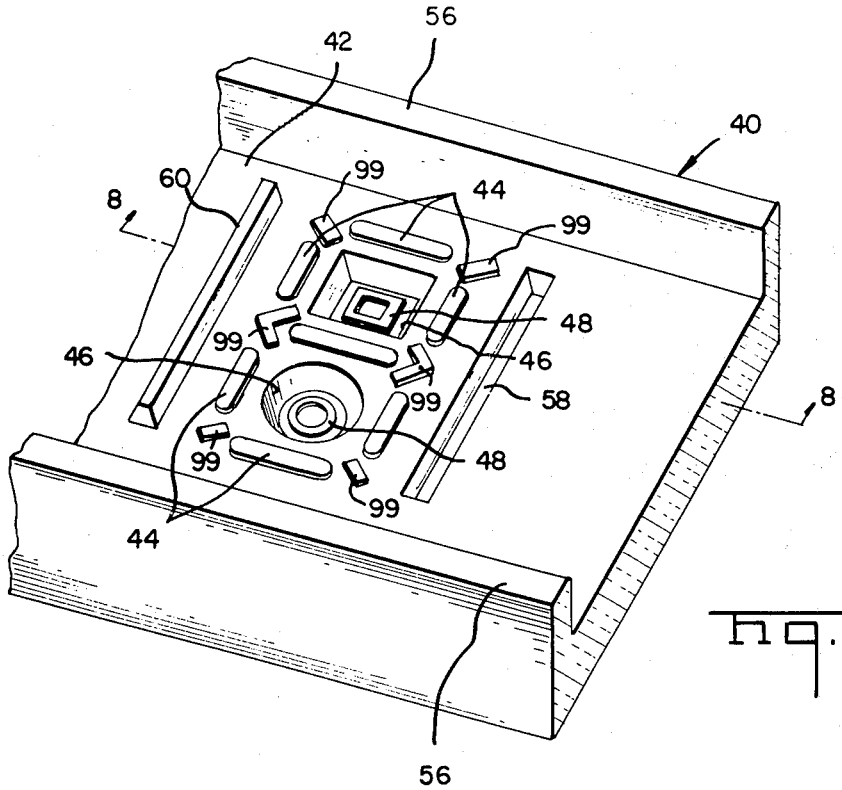
Figure 8:
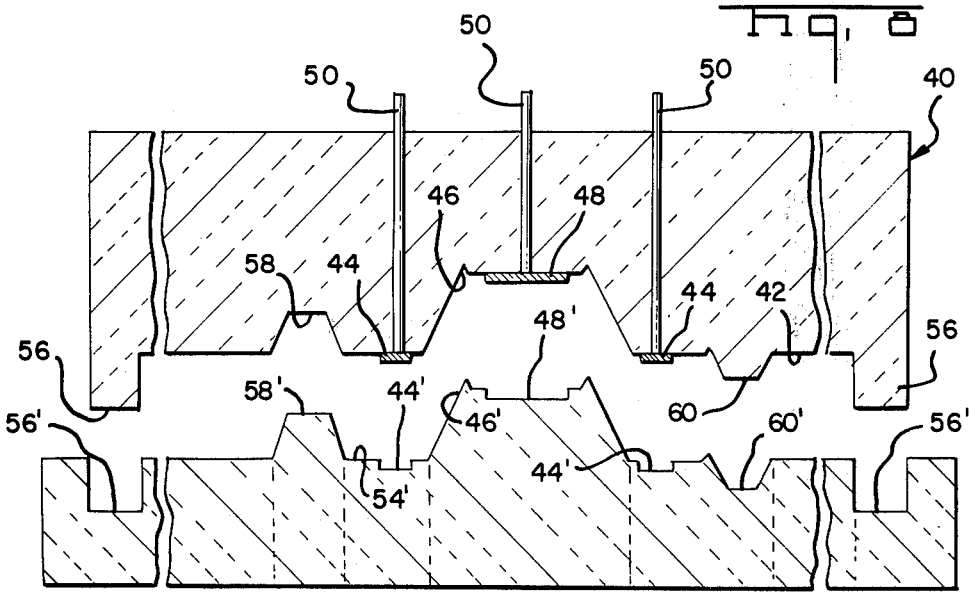
Figure 9:
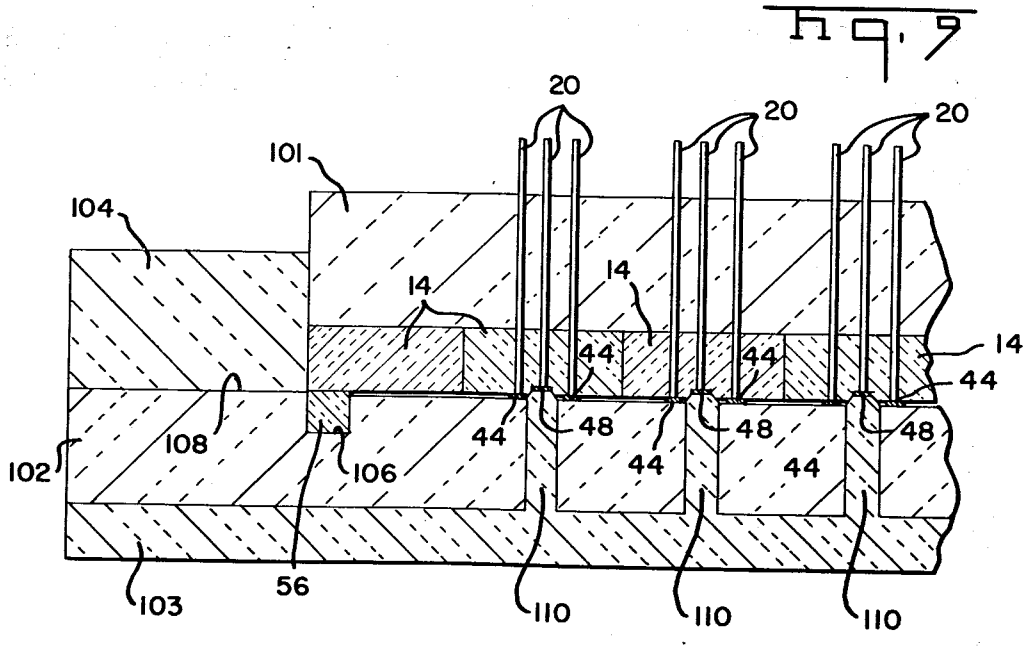
Figure 10:
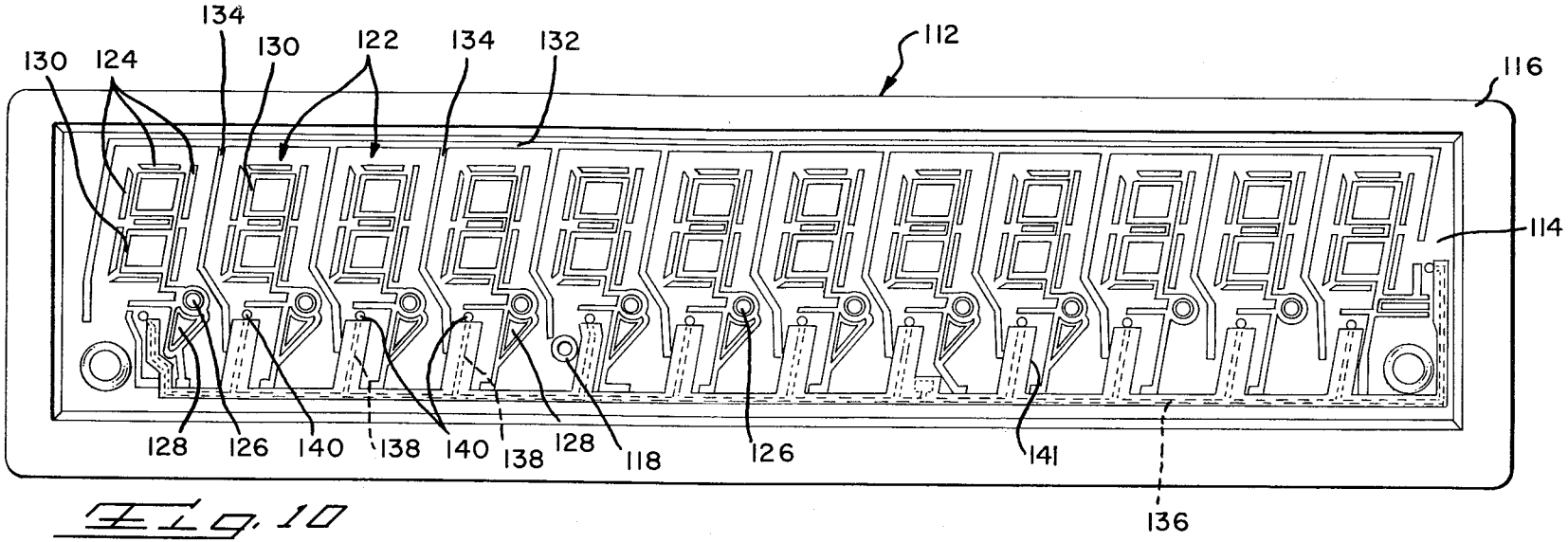
Figure 11:
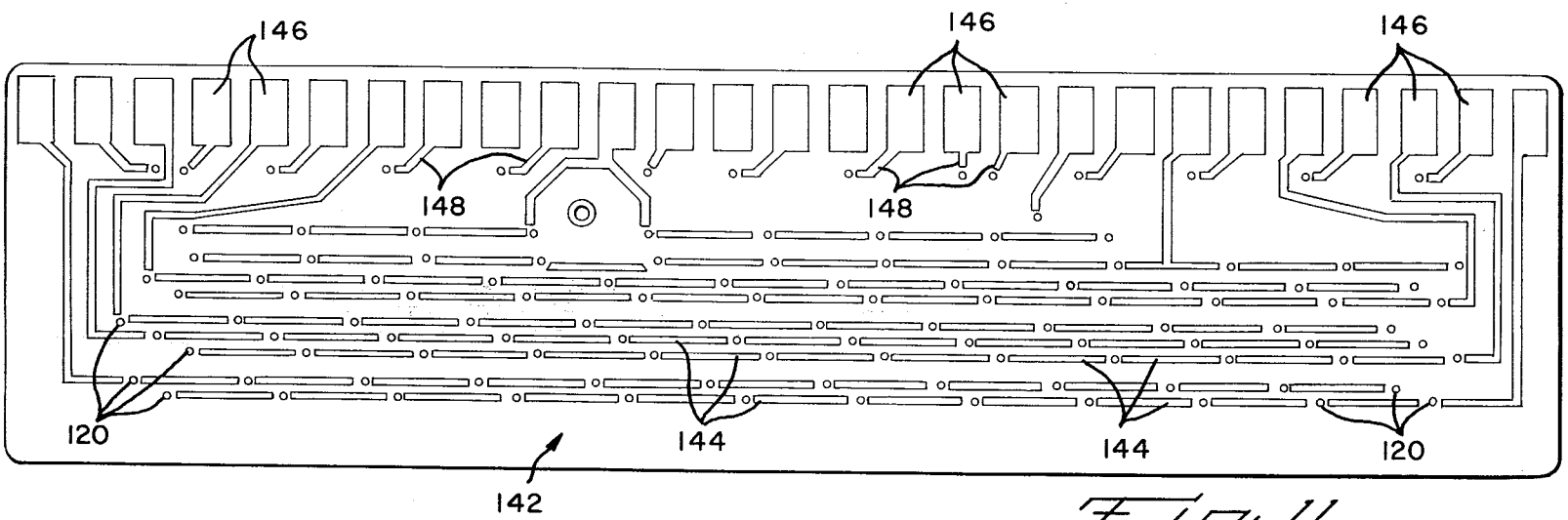

FIG. 5 is a fragmentary elevation with parts illustrated in exploded configuration and in section illustrating the details of the assembly according to the preferred embodiment illustrated in FIG. 1; and FIG. 6 is an enlarged fragmentary elevation in section illustrating the assembly shown in FIG. 5 in assembled configuration with anodes, cathodes and conductive pins fusibly secured to the glass substrate;

FIG. 7 is a fragmentary perspective of another preferred embodiment according to the present invention illustrating in composite form various alternative constructions of a readout device according to the present invention;

FIG. 8 is a section taken generally along the lines 8—8 of FIG. 7 illustrating the device of FIG. 7 in inverted configuration together with a modified carbon molding block;

FIG. 9 is an enlarged cross-section of an alternative embodiment using carbon molding blocks;

FIG. 10 is an enlarged plan of another embodiment according to the present invention;

FIG. 11 is an enlarged plan of a reverse side of the embodiment shown in FIG. 10.

With more particular reference to the drawings, there is illustrated in FIGS. 1 and 5 apparatus for manufacturing a glow discharge display device according to the present invention. The apparatus includes a generally rectangular molding block 1 having a recessed and continuous groove 2 in a rectangular configuration. The planar surface 4 of the molding block 1 is provided with a plurality of recesses machined therein. Some of the recesses are illustrated at 6. As more particular shown in FIG. 1, the recesses are isolated from one another and are purposely not interconnected. The recesses are also purposely arranged in a desired pattern forming the desired configuration of the glow discharge display. Any pattern may be used. However in the specific pattern as shown in FIG. 1, the recesses are arranged to provide a plurality of alpha numeric configurations in order to provide an alpha numeric glow discharge display. As more particularly shown in FIG. 5, the recesses 6 are substantially filled with particles of a suitable cathode material. For example, one suitable cathode material is elemental nickel in particulate form sufficient to pass through a size 320 mesh. Other suitable cathode material in particulate form may be used. The particulate material is compacted into each of the recesses 6 of the molding block 1. The particulate cathode material is thereby distributed in the individual recesses 6 and will form the cathodes of the glow discharge readout apparatus in a manner to be described hereinafter. A frame 9 of fusible glass material is located in the groove 2. To form the required anodes of the glow discharge readout device, reference will be made to FIGS. 1 and 5. As shown in the figures, a pattern of anodes is illustrated generally at 10. In the preferred embodiment of the invention illustrated in FIG. 1, the pattern of anodes is fabricated from a stamped and formed metal grid. As shown in FIGS. 1 and 5, the metal grid is generally rigid and is placed in overlying relationship with respect to the recesses 6 containing the particulate cathode material 8. The actual configuration of the pattern of anodes is more particularly illustrated in FIG. 2 at 10. The overlying relationship of the anode pattern 10 with respect to the particulate cathode material 8 is also illustrated in the figure. As shown in FIG. 5, the stamped and formed metal pattern of anodes includes a plurality of integral contact pins projecting therefrom. One of the contact pins is illustrated at 12. To complete the assembly as illustrated in FIGS. 1 and 5, a plurality of fusible glass bricks 14 are stacked together to form a fusible glass substrate. The bricks are placed in overlying relationship with the pattern of anodes 10 received there-against. The integral contact pins 12 of the pattern of anodes are correspondingly received in apertures 16 provided through the bricks 14. The substrate formed by the bricks 14 is impressed directly over the frame 9 and the metal particles 8 contained within the corresponding recesses 6 of the carbon molding block 1. The pattern of anodes 10 is therefore interposed between the substrate formed by the bricks 14 and the metal particles 8 contained within the recesses 6. In addition, the pattern of anodes 10 is received directly against the planar surface of the substrate formed by the bricks 14. As more particularly shown in FIGS. 1 and 5, each of the bricks 14 is provided with an aperture 16 receiving a contact pin 12 therein. A plurality of additional apertures are provided in the bricks, some of which apertures are illustrated at 18. The additional apertures 18 receive therethrough corresponding metal contact pins, some of which are illustrated at 20. As shown more particularly in FIG. 6, the contact pins 20 are partially imbedded in the particulate cathode material 8 located in the grooves 6 of the molding block 1. In addition, each of the bricks 14 includes a relatively enlarged diameter aperture generally illustrated at 22. A selected one of the apertures 22 receives therein a metal tube 24, the purpose of which will be described hereinafter.

Figure 2:
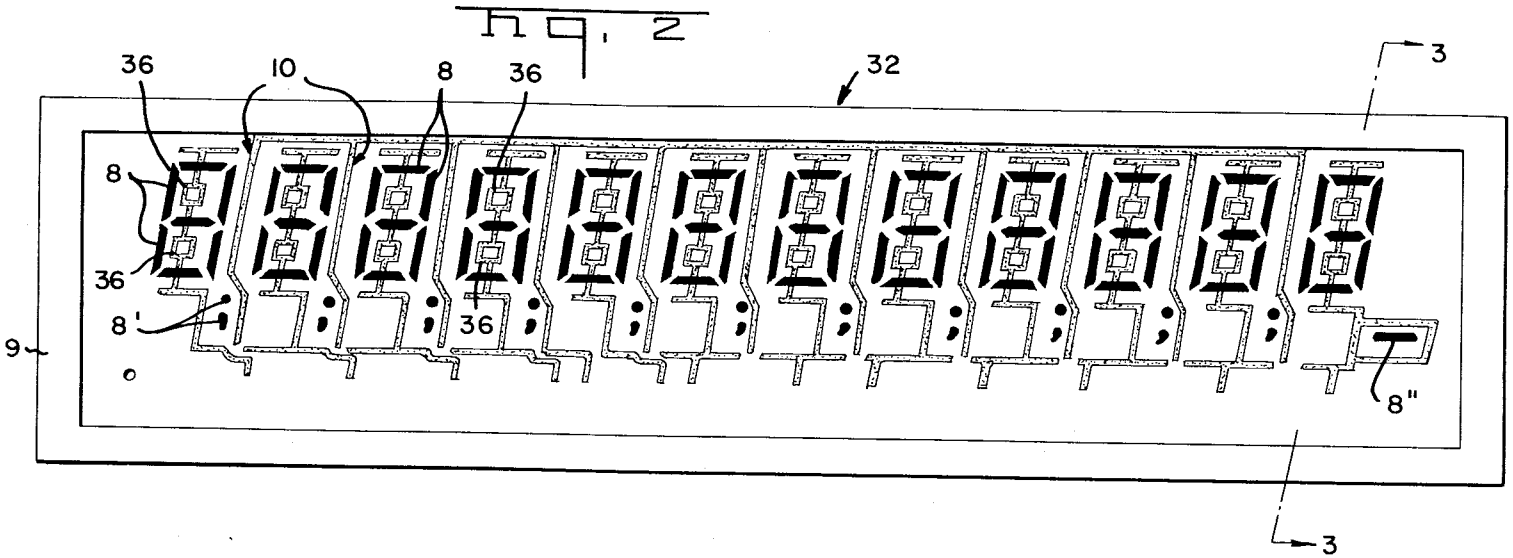
FIG. 2 is a plan view of an exemplary glow discharge readout device according to the present invention fabricated according to the method of the present invention and illustrated prior to receiving a sealably attached transparent cover.

With reference to FIGS. 1, 5 and 6, there is further provided an inverted molding block 26 of carbon having an inverted planar surface 27 impressed over the fusible glass substrate formed by the plurality of bricks 14. The inverted molding block includes an inverted encircling rim 28 which registers around the periphery of the substrate formed by the plurality of stacked bricks 14. As shown in FIG. 6, taken in conjunction with FIGS. 1 and 5, the molding block 26 includes a plurality of apertures some of which are shown at 30 receiving corresponding pins 20 and 12 therein and aligning the pins in parallel fashion when the molding block 26 is impressed over the fusible glass substrate formed by the plurality of bricks 14. In addition the molding block 26 includes a relatively enlarged aperture 32 receiving the metal tube 24 therein, maintaining it in parallel alignment with the pins 20 and 12. As shown in FIG. 6, the weight of the molding block 26 over the bricks 14 applies a molding pressure when the assembly is heated for approximately 18 minutes in a 90%:10% hydrogen and nitrogen atmosphere at a temperature of 1860°F. The bricks 14 are Corning Glass Company 9013 type, fusible glass in powder form compacted to make the individual bricks 14 and the frame 9. Heating at 1860°F occurs at a temperature below the melting point of the nickel particles of the cathode material 8 but at a temperature sufficient to fuse the glass material forming the bricks 14 and the frame 9. The described heating cycle will fuse the particles of the fusible glass bricks 14 to form a continuous rectangular substrate as shown in FIG. 2 generally at 32. In addition, the substrate will be substantially non-porous and will fuse in encirclement about the pins 12 and 20 and the metal tube 24. The pins and the tube are advantageously selected from 52%:48% nickel and iron so as to have a coefficient of expansion compatible with that of the fusible glass particles of the bricks 14. During the heating cycle the particles of the fusible glass will bond sealably in encirclement around the pins and tube without voids being created by differential expansion.

A particular feature according to the present invention resides in the fact that the fusible glass particles in a molten or melted state will flow down into the recesses 6 and become bonded to the particulate cathode material 8 in the recesses. The same flowing action will also fuse the frame 9 unitarily to the substrate 32 and will cause the apertures 22 to disappear or close up during flowing of the glass substrate in the heating or firing operation. With reference to FIGS. 2 and 3, the invention will be further described in detail. After the heating cycle is completed, the assembly is cooled to room temperature and the molding blocks 1 and 26 removed. As shown in FIG. 3, the flowing of the fusible glass into the recesses 6 during the firing operation forms projecting platforms or projections which are generally trapezoidal in cross section, the metal particles 8 being bonded to the projections or platforms upon partial diffusion of the particles into the glass forming the platforms. In addition, the glass when solidified holds the individual particles of each recess into a cohesive mass, compressing the particles of the cohesive mass in compression with one another in mechanical and electrical contact. The particles 8 are thereby sintered at a temperature below their melting point during the heating operation and are electrically in contact with each other and held in place by the fusible glass forming the platforms or projections 34. If desired, the cathode particles 8 may be arranged to form a plurality of alpha numeric readout patterns as shown in FIG. 2. Also additional particles of cathode material may be arranged and formed by the sintering process into a desired pattern representing a perido and comma as shown at 8'. As shown in FIG. 3, still additional cathode particles may be arranged and formed into a minus sign as above at 8''. The pattern of metal particles 8, 8' and 8'' thereby form the cathodes of the glow discharge readout device according to the present invention. As shown in FIG. 3 the pattern of anodes 10 includes loop portions 36 respectively surrounded by selected cathodes formed by the cathode material 8. Such loop portions 36 are interconnected by anode bridging portions 38 connecting the loop portions 36 to the remaining part of the pattern of anodes externally of the selected encircling cathodes. The cathodes are electrically isolated from the anode bridging portions 38 by the fusible glass substrate which has flowed into the recesses 6 of the molding block 1 during the firing operation to form the raised platforms or projections 34. Thus during formation of the platforms 34 by flowing of the fusible glass material, the flowing glass also operates to electrically isolate the cathodes from the bridging portions 38 of the anodes which become imbedded in the glass forming the resulting platforms 34. Also during the firing operation, the pattern of anodes 10 becomes fusibly adhered to the molten surface of the glass substrate 32 during the firing operation. To complete the glow discharge readout according to the present invention, a conventional transparent glass cover (not shown) is adhered to the frame 9 in a conventional manner, such as by utilizing a fusible sealant and bonding agent between the glass cover and the frame 9. This encases the anodes and cathodes within a transparent hermetically sealed envelope. The space within the envelope is defined between the surface of the substrate 32 and the transparent window. The space is then evacuated and backfilled with a suitable illuminating gas according to techniques well known in the prior art. Evacuation of the envelope space and introduction of gas may be introduced through the metal tube 24 which may be advantageously sealed closed after introduction of the illuminating gas into the envelope space. The projecting pins 12 and 20 may be advantageously connected to a printed circuit board, or to a printed circuit silk screened directly on the exterior planar surface of the substrate 32. The specific type of printed circuit which is on a separate board or silk screened to the substrate is of conventional design and is thus not illustrated. However the present invention is readily suited for silk screening the printed circuit directly to the exterior surface thereof in contact with the pins 20 and 12.

As another feature according to the present invention, the anode portions 36 are purposely recessed with respect to the cathodes formed by the cohesive mass of particles 8, forming the cathodes. In operation, a voltage is impressed across the anodes and selected cathodes to produce a desired alpha numeric glow discharge readout in the conventional manner. However since the anode portions 36 as well as the remaining anode portions of the pattern 10 are recessed with respect to the cathodes, the electron stream will be directed from the cathodes downwardly toward the surface of the substrate 32 and will be focused at the recessed anode portions on the surface of the substrate. The electron stream or flow will thereby be directed away from the transparent window preventing discoloration thereof by stray electron bombardment. The trapezoidal shape of the platforms 34 will allow flow of electrons along the shortest possible path from the cathodes to the anode portions without collision with, or migration through, the fusible glass forming the platforms 34. Such action thereby insures a maximum foot-Lambert brightness of the glow discharge. Further to increase the foot-Lambert output of the glow discharge, each of the cathodes is formed by cathode material which is of separate particle form. The separate particles although in a cohesive mass as described give the cathodes a very rough surface having projecting portions formed by individual particles and valleys or crevices formed between irregular surfaces of adjacent abutting particles. When electrons are emitted from the surfaces of the selected cathodes some are emitted from the crevices so as to collide with one another and with the protruding particles of the cathodes to create an electron bombardment or cascading effect, further inducing additional electron emission and increasing the foot-Lambert output of the glow discharge. The rough surface also reduces tendency of the cathode material to sputter away from the crevices which trap the sputtered material.

Figure 4:
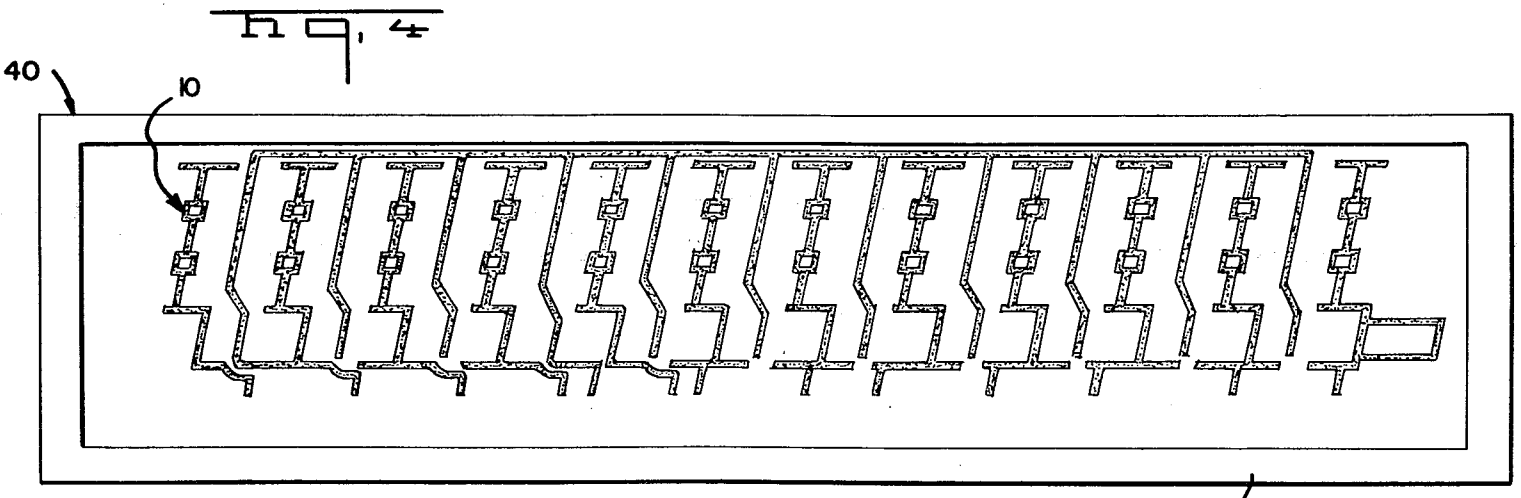
FIG. 4 is a preferred embodiment of an anode pattern received against a fusible glass substrate and thereby forming component parts of the glow discharge readout apparatus according to the present invention.

FIG. 4 illustrates a modification, wherein the bricks 14 of the embodiment of FIGS. 1–3, 5 and 6, are replaced by a substituted unitary plate 40 of fusible ceramic or glass material similar to the bricks 14. The substituted plate 40 thus provides a substrate on which the anodes and cathodes are adhered during the described sintering and heating operation. As shown in FIG. 4, the pattern of anodes 10 may be placed against the substrate prior to the heating process. Since the substrate is unitary, the anode pattern may be silk screened directly to the surface without a need for a formed metal pattern of anodes as required in the embodiment of FIGS. 1–3.

Another way to recess the anodes would be to create depressions in the substrate during the molding process. This can be accomplished by depressing the glass substrate by the carbon molding block during the heating operation. This will depress the anodes with respect to the cathodes.

As shown in FIG. 7, a modification of the readout device is generally indicated at 40. The glass substrate 42 is provided with a plurality of cathodes 44 deposited directly on the surface of the substrate by a cohesive mass of particulate metal adhered to the surface of the substrate 42 by a sintering process similar to that as previously described. Accordingly the formed cathodes 44 are adhered directly to the surface of the substrate 42, rather than on projecting portions as heretofore described in the embodiment illustrated in FIGS. 1–5. Since the invention is directed toward recessing the anodes with respect to the cathodes, reference is made to FIGS. 7 and 8 wherein recesses 46 are each provided with anode portions 48 similar in configuration to the rectangular or round configuration of the recesses 46. The recesses 46 may be of any desired configuration. As shown in FIGS. 7 and 8, the substrate 42 is provided with a plurality of contact pins 50 therein which are assembled to the substrate in a manner similar to the assembly of the embodiment previously described in conjunction with FIGS. 1–5. The pins 50 contact respectively the anode portions 44 or the cathode portions 48. In this embodiment it is understood that each anode portion 48 is provided with its own contact pin 50, rather than being interconnected by anode bridging portions which are incorporated into the preferred embodiment of FIGS. 1–5. As shown in FIG. 8 a carbon molding block 52 is utilized which has a tapered projecting portion 46' having a recess portion 48' therein. In addition, the molding block 42 has a planar surface 54 from which the projecting portion 46' protrudes. The planar surface 54 has a plurality of recesses 44' therein which are of the same configuration as the desired cathode portions 44 of the preferred embodiment 40. With reference to FIG. 8, the glass substrate 40, with the pins 50 assembled therein, is compressed over the carbon block 52. In the version as shown, the anode portions 44 and the cathode portions 48 may be deposited upon the glass substrate 40 which is preformed with the recess 46. For example the anode portions 44 and cathode portions 48 may be deposited by silk screening a quantity of discrete metal particles in a binder which sublimes during sintering at elevated temperatures. The assembly is then placed in registration over the carbon block 52, with the recess portions 44' of the carbon block receiving the cathode portions 44 therein, and with the recess portion 48' of the carbon block receiving the cathode portion 48 therein. The assembly is then provided thereover with the carbon block 26 which was utilised in the fabrication of the preferred embodiment discussed in conjunction with FIGS. 1–5. The assembly is then sintered to simultaneously adhere the metal particles of the anode portions 44 and the cathode portions 48 into a coherent mass of individual particles to provide anodes and cathodes having the same characteristics as those resulting from the fabrication of the preferred embodiment discussed in conjunction with FIGS. 1–5. The configuration of the carbon block 52 with its recessed portions 44' and 48' and its projecting portion 46' will mold the fusible glass of the substrate 40 to the desired configuration having recessed anodes, which configuration is shown in FIG. 7. In addition the sintering process fusibly and sealably adheres the anode portions 48, the cathode portions 44 and the pins 50 sealably to the substrate 40. The substrate 40 includes a projecting frame 56 to which the transparent window is sealably attached. The frame is formed by flowably conforming the fusible glass to a continuous recess 56' of the molding block 52.

As an alternative way of fabricating the preferred embodiment shown in FIG. 7, metal particles forming the anodes and cathodes may be first deposited in the recesses 44' and 48' of the carbon block 52. The fusible glass substrate 40 then may overlie the carbon block 52 with the pins 50 being assembled within the fusible substrate and in contact with the respective anodes and cathodes. In this alternative fabrication technique, the fusible glass substrate 40 need not be preformed with the recesses 46. Instead, during the sintering operation, the glass will be reduced to a fusible state and will flowably conform itself to the configuration of the carbon molding block 52. The recesses 46 containing the resultant anodes 48 will thus be formed in the fusible glass substrate and the anodes and cathodes will adhere to the glass, without a need for preforming the substrate prior to the sintering process.

In each of the preferred embodiments, the glass substrate sealably adheres to the contact pins to provide hermetic seals encircling the pins. In many prior art devices, the methods of assembly do not lend themselves to providing a hermetic seal in encirclement around each of the contact pins. The glass substrate of a prior art device must then be encapsulated within a glass envelope such as an electron tube. In the present invention, the glass substrate itself, together with the transparent cover plate serves as the envelope receiving the illuminating gas therein. This obviates the need for assembling the device within an electron tube.

As shown in FIG. 7, each alpha numeric character may be separated from an adjacent one on the substrate 42 by either a recessed barrier 58 or a projecting barrier 60 formed by a corresponding molding portion 58' and 60' on the carbon molding block 52 which form the substrate 40 with the barriers 58 and 60 during the molding operation as described. The barriers 58 and 60 provide a lengthened effective surface area between adjacent alpha numeric characters, thereby lengthening the bridging path between adjacent characters. The increased bridging path prevents the possibility of shorting between adjacent alpha numeric characters which might be caused by sputtered cathode material scattered upon the bridging path and causing an electrical connection between adjacent alpha numeric characters. Either a recessed barrier 99 or projecting barrier 99 may also be provided between the segments 44 of each display character, which barriers are similar to the barriers 58 and 60.

FIG. 9 is an enlarged cross section of an alternative using carbon molding blocks 101, 102, 103, and 104. Recess 106 receives glass to form the frame 56. Glass preforms 14 are placed between blocks 101 and 102. The contact pins 20 are held in corresponding apertures of block 101. The cathode portions 44 are silk screened on the surface 108 of block 102. Block 103 has projections 110 which protrude through block 102. The anodes 48 are silk screened on the ends of the projections 110. When the assembly is slightly compressed, the projections 110 will protrude from the surface 108. The glass preforms 14 will flow around the projections 110 and will thereby form the recesses 46 as shown in the embodiment of FIG. 7. The anodes 48 and cathodes 44 will adhere to the reflowed glass and will transfer from the carbon blocks 102 and 103.

According to a further modification of the present invention, a low uniform operating voltage for lighting the display by ionization of the illuminating gas is desirable. Using a common Neon-Argon gas mixture charged with a component of commercially available radio-active gas such as Krypton 85, the ionization and reionization time of the plasma which causes illumination can be made very low. The radio-active gas in a trace amount is sufficient to supply a low level of charged ions at all times, enabling very quick reionization of the Neon-Argon mixture to a relatively high level, causing the desired illumination of the readout. In addition, the gas pressure within the hermetic envelope of the panel is purposely substantially increased beyond atmospheric up to 760 mm Hg. Due to the increased conductivity of the gas mixture provided by the radio-active gas component the internal gas pressure of the panel envelope may be maintained up to atmospheric, which is an improvement over a vacuum tube type envelope wherein the low internal pressure substantially increases the ionization time beyond that practical for an instantaneous display of a digital readout.

In addition, the anodes of the readout may be manufactured either flush with the cathodes or at different levels than the cathodes, as described in the previous embodiments. Once the pressure of the panel envelope is increased above 100 mm Hg, and as high as 760 mm Hg, the physical spacing between anode and cathode may be adjusted to less than 0.01 inches. The increased pressure in the panel reduces the possibility of sputtering of the cathode material which is always present in a low pressure vacuum type tube. With reduced sputtering there is a reduction in the possibility of creating a shorting bridge between anode and cathode even at such close spacing. With the anodes and cathodes closely spaced, the operational voltage for ionization may then be reduced to 175 volts and below. The relatively close spacing of the anodes and cathodes sustain ionization of the illuminating gas or the plasma. Because sputtering is negligible due to the higher pressure inside the panel, the life of the panel is substantially lengthened. Thus higher pressure within the panel envelope reduces sputtering and permits lower operating voltages with the anodes and cathodes closer together. With negligible sputtering and lower operating voltage, life of the plasma display is greatly extended.

A technique for greatly reducing the reionization time of the illuminating gas mixture is accomplished by maintaining a DC or AC voltage between the anodes and cathodes at a level just below that required for illumination. Then a scanning voltage is impressed across the anodes and cathodes to sustain illumination. Alternatively a set of constantly illuminated cathodes may be utilized in the panel but remote from the numerical display cathodes in order to sustain plasma constantly and uniformly within the panel envelope. The maintains a uniform voltage level when placed in a circuit, for example, containing MOS circuit elements. Then when a scanning or multiplexing voltage is impressed across the cathodes of the digits display, illumination or plasma is sustained with a reionization time of approximately 25 to 30 microseconds. For example, with a multiplexing voltage of 148 volts, plasma may be sustained across the display cathodes when placed at 0.01 inches spacing from corresponding anodes. The scanning voltage level is insufficient to cause a reaction voltage spike through the circuit and across the MOS elements, thereby preventing damage thereto.

The embodiment of the present invention wherein Krypton 85 and adjacent coplanar anodes and cathodes are utilized appears in FIGS. 10 and 11.

With more particular reference to FIG. 10, a fusible ceramic glass substrate 112 includes a planar surface 114 and an integral frame 116. An evacuation tube 118 and a plurality of pins, some of which are shown at 120 are fusibly embedded in the substrate 112, according to the assembly techniques as described. In this embodiment, each numerical display, some indicated generally at 122, is fabricated from a plurality of cathodes 124 arranged in the familiar alphanumeric pattern. Additional cathodes 126 and 128 form periods and commas respectively.

Additionally each numerical display 122 is provided with a central anode electrode 130 in the form of two enclosed rectangles connected together and generally encircled by the cathodes 124 of each numerical display. The anode 130 additionally projects outwardly of the display to encircle a period 126 and comma 128 associated with each numerical display 124. Another anode 132 extends the length of the panel and has a plurality of depending strips 134 thereof which separate adjacent numerical displays 122 to form anode guard strips preventing stray voltages and sympathetic glow discharge of adjacent numerical displays when nearby displays are activated to produce glowing or illuminating gas plasma.

Another cathode 136 extends entirely along the length of the panel 112 and includes a plurality of projecting portions 138 extending toward corresponding individual displays 122. The projecting portions 138 each terminates in a circular portion 140. An opaque coating of fusible glass or ceramic material 141 overlies the cathode portions 136 and 138, leaving the circular portions 140 exposed. The anodes and cathodes are respectively connected to corresponding pins 120 which connect the anodes and cathodes to circuitry indicated generally at 142 and deposited by silk screening, for example, on the reverse surface of the panel 112. Circuitry 142 includes conductor paths 144 which electrically common selected pins 120 to circuit pads 146 located at the edge of the reverse surface of the panel 112. Certain other circuit paths 148, for example, connect individual pins to additional circuit pads 146. In operation of the panel, the electrical pads 146 are connected in a well-known fashion to the programming circuitry for selectively lighting the numerical displays 122. When the panel 122 is covered by a transparent window, not shown, and illuminating gas containing Krypton 85 as a component thereof is sealably enclosed within the panel 112, the cathode 136 may remain constantly energized at a voltage level sufficient to produce quantities of ionized plasma, causing the exposed circular portions 140 of the cathodes to appear as continuously lighted dots. Since the dots are evenly distributed along the length of the panel 112 the constantly ionized gas plasma is also distributed entirely along the length of the panel. Thus when changing the illuminated displays to different numbers, the presence of the continuously ionized plasma reduces the reionization time of the plasma generated by the selectively illuminated displays 122. Thus the presence of charged ions at all time enables very quick reionization of the illuminating gas to produce a nearly instantaneous display of the desired numerical readout. The coating 141 is provided to minimize both the brightness and the total area of the cathode 136 which is maintained in continuous operation. In addition, the exposed portions 140 of the cathode 136 may also be covered by a shield, not shown, provided on the transparent cover in order to prevent visual distraction away from the illuminated displays 122. To further minimize visual distraction, the anodes material 132 and 130 may be fabricated from tungsten carbide which provides a low luster, dark apearance contrasting with the brightly illuminated cathodes of the displays 122. The tungsten carbide is applied in powder form together with a binder material by silk screen or other similar process. The tungsten carbide particles are fusibly imbedded permanently in the surface of the panel 112 upon firing.

Although preferred embodiments and modifications of the present invention have been shown and described in detail, other embodiments and modifications of the present invention are intended to be covered in the spirit and scope of the appended claims, wherein:

I claim:

1. A method for making a readout device, comprising the steps of:

placing conductive material arranged in a predetermined pattern of anodes and cathodes on a fusible substrate provided with an integral raised frame, locating conductive pins in contact with said material and extending in protruding relationship from said substrate, locating a tube through said substrate, heating said substrate to fuse said substrate in sealed encirclement around said tube and said pins and to adhere said anode and cathode conductive material to said substrate surface, partially covering one of said cathodes with a coating of fusible material leaving an exposed portion of said partially covered cathode to provide a continuously energized cathode during operation of said readout device, sealably adhering a transparent window on said frame to provide an envelope containing said pattern of anodes and cathodes, introducing an illuminating type gas into said envelope through said tube, and sealably closing said tube to provide a sealed envelope containing illuminating gas and anodes and cathodes with conductive pins protruding through said substrate and in contact with corresponding anodes and cathodes.

2. A method as recited in claim 1, and further including the step of:

filling said envelope with an illuminating gas comprising an Neon-Argon gas mixture together with a quantity of Krypton 85 radio-active gas and at pressure internally of the envelope greater than atmospheric.

3. A method of making a readout device, comprising the steps of:

placing conductive material arranged in a predetermined pattern of anodes and cathodes on a fusible substrate provided with an integral raised frame, locating conductive pins in contact with said material in extending and protruding relationship from said substrate, locating a tube through said substrate, heating said substrate to fuse said substrate in sealed encirclement around said tube and said pins and to adhere said anodes and cathodes conductive material to said substrate surface, molding recesses in said substrate during said step of heating to provide selected ones of said anodes in said recesses, sealably adhering a transparent window on said frame to provide an envelope containing said pattern of anodes and cathodes, introducing an illuminating type gas into said envelope through said tube, and sealably closing said tube to provide a sealed envelope containing illuminating gas and anodes and cathodes with conductive pins protruding through said substrate and in contact with corresponding anodes and cathodes.

* * * * *